US008763574B2

(12) United States Patent
Plate et al.

(10) Patent No.: US 8,763,574 B2
(45) **Date of Patent: *Jul. 1, 2014**

(54) DEVICE FOR VARIABLY ADJUSTING THE CONTROL TIMES OF GAS EXCHANGE VALVES OF AN INTERNAL COMBUSTION DEVICE

(75) Inventors: Jurgen Plate, Gerhardshofen (DE); Jochen Auchter, Gerhardshofen (DE); Lutz Witthoft, Aurachtal (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 87 days.

This patent is subject to a terminal disclaimer.

(21) Appl. No.: 13/386,217

(22) PCT Filed: Aug. 23, 2010

(86) PCT No.: PCT/EP2010/062212

§ 371 (c)(1),
(2), (4) Date: Jan. 20, 2012

(87) PCT Pub. No.: WO2011/032805

PCT Pub. Date: Mar. 24, 2011

(65) Prior Publication Data

US 2012/0111295 A1 May 10, 2012

(30) Foreign Application Priority Data

Sep. 18, 2009 (DE) ..... 10 2009 042 202

(51) Int. Cl.
*F01L 1/34* (2006.01)

(52) U.S. Cl.
USPC ..... 123/90.17; 123/90.12

(58) Field of Classification Search
USPC ..... 123/90.15–90.18, 90.33, 90.34, 90.12
See application file for complete search history.

(56) References Cited

U.S. PATENT DOCUMENTS 4,903,650 A 2/1990 Ohlendorf et al.
5,107,804 A 4/1992 Becker et al.

(Continued)

FOREIGN PATENT DOCUMENTS

DE 4218078 1/1994
EP 0806550 11/1997

(Continued)

*Primary Examiner* — Thomas Denion
*Assistant Examiner* — Steven D Shipe
(74) *Attorney, Agent, or Firm* — Volpe and Koenig, P.C.

(57) ABSTRACT

A device (11) for variably adjusting the control times of gas exchange vales (9, 10) of an internal combustion engine (1) having a hydraulic phase adjustment device (12) and at least one volume accumulator (31), wherein the phase adjustment device (12) can be brought into driving connection with a crankshaft (2) and a camshaft (6, 7) and at least one early adjustment chamber (24) and at least one late adjustment chamber (25) which can be supplied with pressure medium via pressure medium lines (26*a, b, p. v*), or from which pressure medium can be drained. A phase position of the camshaft (6, 7) can be adjusted relative to the crankshaft (2) in the direction of early control times by supplying pressure medium to the early adjustment chamber (24) while simultaneously draining pressure medium from the late adjustment chamber (25), wherein a phase position of the camshaft (6, 7) can be adjusted relative to the crankshaft (2) in the direction of late control times by supplying pressure medium to the late adjustment chamber (25) while simultaneously draining pressure medium from the early adjustment chamber (24), wherein pressure medium can be supplied to the volume accumulator(s) (31) during operation of the internal combustion engine (1).

10 Claims, 6 Drawing Sheets

(56) References Cited

U.S. PATENT DOCUMENTS

| | | | | |
|---|---|---|---|---|
| 5,704,317 | A * | 1/1998 | Barth | 123/90.17 |
| 5,775,279 | A * | 7/1998 | Ogawa et al. | 123/90.17 |
| 6,035,819 | A * | 3/2000 | Nakayoshi et al. | 123/90.17 |
| 2007/0261651 | A1* | 11/2007 | Suzuki et al. | 123/90.17 |
| 2009/0133652 | A1 | 5/2009 | Fujyoshi et al. | |
| 2011/0114047 | A1* | 5/2011 | Hohmann et al. | 123/90.15 |
| 2011/0232595 | A1* | 9/2011 | Kokubo et al. | 123/90.17 |
| 2012/0304947 | A1* | 12/2012 | Bogershausen | 123/90.17 |

FOREIGN PATENT DOCUMENTS

| | | | |
|---|---|---|---|
| EP | 1607590 | | 12/2005 |
| WO | WO 2009089984 | A1 * | 7/2009 |

* cited by examiner

DEVICE FOR VARIABLY ADJUSTING THE CONTROL TIMES OF GAS EXCHANGE VALVES OF AN INTERNAL COMBUSTION DEVICE

BACKGROUND

The invention relates to a device for variably adjusting the timing of gas exchange valves of an internal combustion engine having a hydraulic phase adjustment unit and at least one volume accumulator, wherein the phase adjustment unit can be brought into drive connection with a crankshaft and a camshaft and at least one advance chamber and at least one retardation chamber, which can be supplied with pressure medium or from which pressure medium can be discharged via pressure medium lines, wherein a phase position of the camshaft relative to the crankshaft can be adjusted in the direction of early timing by supplying pressure medium to the advance chamber while simultaneously allowing pressure medium to flow out of the retardation chamber, wherein a phase position of the camshaft relative to the crankshaft can be adjusted in the direction of late timing by supplying pressure medium to the retardation chamber while simultaneously allowing pressure medium to flow out of the advance chamber, wherein pressure medium can be supplied to the volume accumulator or accumulators during the operation of the internal combustion engine.

In modern internal combustion engines, devices for variably adjusting the timing of gas exchange valves are used to enable variable configuration of the phase position of a camshaft relative to a crankshaft within a defined angular range between a maximum advance position and a maximum retardation position. For this purpose, a hydraulic phase adjustment unit of the device is integrated into a drive train via which torque is transmitted from the crankshaft to the camshaft. This drive train can be implemented as a belt, chain or gear drive, for example. The phase adjustment speed and the pressure medium requirement are significant parameters of such devices. To enable the phase position to be adapted in an optimum manner to the various driving situations, high phase adjustment speeds are desirable. In the context of measures for reducing consumption, there is furthermore a demand for an ever smaller pressure medium requirement so as to enable the pressure medium pump of the internal combustion engine to be of smaller design or to enable the delivery rate to be reduced when using controlled pressure medium pumps.

A device of this kind is known from EP 0 806 550 A1, for example. The device comprises a phase adjustment unit of the vane cell type with a drive input element, which is in drive connection with the crankshaft, and a drive output element, which is connected to the camshaft for conjoint rotation therewith. A plurality of pressure spaces is formed within the phase adjustment unit, wherein each of the pressure spaces is divided into two pressure chambers with an opposed action by means of a vane. The vanes are moved within the pressure spaces by supplying pressure medium to or discharging pressure medium from the pressure chambers, thereby bringing about a change in the phase position between the drive output element and the drive input element. In this case, the pressure medium required for phase adjustment is made available by a pressure medium pump of the internal combustion engine and is directed selectively to the advance or retardation chambers by means of a control valve. The pressure medium flowing out of the phase adjustment unit is directed into a pressure medium reservoir, the oil sump of the internal combustion engine. Phase adjustment is thus accomplished by means of the system pressure made available by the pressure medium pump of the internal combustion engine.

Another device is known from U.S. Pat. No. 5,107,804 A, for example. In this embodiment, the phase adjustment unit is likewise of the vane cell type, and a plurality of advance and retardation chambers is provided. In contrast to EP 0 806 550 A1, phase adjustment is not accomplished by supplying pressure medium to the pressure chambers by means of a pressure medium pump; instead, alternating moments acting on the camshaft are used. The alternating moments are caused by the rolling movements of the cams on the gas exchange valves, each of which is preloaded by a valve spring. In this case, the rotary motion of the camshaft is braked during the opening of the gas exchange valves and accelerated during closure. These alternating moments are transmitted to the phase adjustment unit, with the result that the vanes are periodically subjected to a force in the direction of the retardation stop and of the advance stop. As a result, pressure peaks are produced alternately in the advance chambers and the retardation chambers. If the phase position is supposed to be held constant, pressure medium is prevented from flowing out of the pressure chambers. In the case of a phase adjustment in the direction of earlier timing, pressure medium is prevented from flowing out of the advance chambers, even at times at which pressure peaks are being produced in the advance chambers. If the pressure in the advance chambers rises owing to the alternating moments, this pressure is used to direct pressure medium out of the retardation chambers into the advance chambers, using the pressure of the pressure peak generated. Phase adjustment in the direction of later timing is accomplished in a similar way. In addition, the pressure chambers are connected to a pressure medium pump, although only to compensate for leaks from the phase adjustment unit. Phase adjustment is thus accomplished by diverting pressure medium out of the pressure chambers to be emptied into the pressure chambers to be filled, using the pressure of the pressure peak generated.

Another device is known from US 2009/0133652 A1. In this embodiment, phase adjustment at small alternating moments is accomplished, in a manner similar to the device in EP 0 806 550 A1, by supplying pressure to the advance chambers or the retardation chambers by means of a pressure medium pump while simultaneously allowing pressure medium to flow out of the other pressure chambers to the oil sump of the internal combustion engine. In the case of high alternating moments, as in the device in U.S. Pat. No. 5,107,804 A, these are used to direct the pressure medium under high pressure out of the advance chambers (retardation chambers) into the retardation chambers (advance chambers). During this process, the pressure medium expelled from the pressure chambers is fed back to a control valve, which controls the supply of pressure medium to or discharge of pressure medium from the pressure chambers. This pressure medium passes via check valves within the control valve to the inlet port, which is connected to the pressure medium pump, wherein some of the pressure medium is expelled into the pressure medium reservoir of the internal combustion engine.

SUMMARY

It is the underlying object of the invention to provide a device for variably adjusting the timing of gas exchange valves of an internal combustion engine while increasing the phase adjustment speed thereof.

According to the invention, the object is achieved by virtue of the fact that at least two pressure medium channels are provided in addition, wherein the first pressure medium channel opens into one of the volume accumulators, on the one hand, and communicates with the advance chamber, on the other hand, wherein the second pressure medium channel opens into one of the volume accumulators, on the one hand, and communicates with the retardation chamber, on the other hand, and wherein each of the pressure medium channels is assigned a check valve, which prevents a pressure medium flow from the respective pressure chamber to the volume accumulator and can permit a pressure medium flow in the opposite direction.

The device has a hydraulic phase adjustment unit which has at least two pressure chambers with an opposed action, at least one advance chamber and at least one retardation chamber. The invention can be applied to any type of hydraulic phase adjustment unit, e.g. devices of the vane cell type, as disclosed in EP 0 806 550 A1, in the form of axial piston adjusters, as disclosed in DE 42 18 078 C1, for example, or in the form of pivoted lever adjusters, as disclosed in U.S. Pat. No. 4,903,650 A, for example.

The phase adjustment unit has at least one drive input element and one drive output element, wherein the drive input element is in drive connection with a crankshaft of the internal combustion engine, e.g. via a chain, belt or gear drive. The drive output element is in drive connection with the camshaft. This can likewise be effected by means of a chain, belt or gear drive or by means of a connection between the camshaft and the drive output element for conjoint rotation, for example.

By means of a pressure medium line, pressure medium is fed to and discharged from the pressure chambers. The pressure medium can be made available by a pressure medium pump of the internal combustion engine, for example, and the pressure medium to be discharged from the pressure chambers can be directed into a pressure medium reservoir, e.g. the oil sump of the internal combustion engine. It is thus possible to variably adjust the phase position of the device, even in the case of small alternating moments.

The device furthermore has one or more volume accumulators for holding pressure medium. The pressure medium can be stored in the unpressurized condition or under pressure in the volume accumulator or accumulators. During the operation of the internal combustion engine, the pressure medium is fed to the volume accumulator or accumulators.

In addition to the pressure medium lines which connect the pressure chambers to the pressure medium pump and the pressure medium reservoir, at least two pressure medium channels are provided, which connect the volume accumulator or accumulators to the pressure chambers. In this case, one end of each pressure medium channel opens into one of the volume accumulators, while the other end of the first pressure medium channel communicates with the advance chamber or chambers and the other end of the second pressure medium channel communicates with the retardation chamber or chambers. In this case, the first pressure medium channel communicates exclusively with the advance chamber or chambers and not with the retardation chambers. Similarly, the second pressure medium channel communicates exclusively with the retardation chamber or chambers and not with the advance chambers.

Embodiments with just one volume accumulator, which communicates with all the pressure chambers via the pressure medium channels, are conceivable, for example. Likewise conceivable are embodiments in which a plurality of volume accumulators is provided. In this case, some of the volume accumulators can communicate exclusively with the advance chambers while some of the volume accumulators communicate exclusively with the retardation chambers, for example. It is likewise conceivable for each volume accumulator to be assigned two pressure chambers, e.g. an advance chamber and a retardation chamber, with which the respective volume accumulator communicates via the pressure medium channels.

In addition to the embodiments in which two pressure medium channels are provided, in which the first/second pressure medium channel communicates with all the advance/retardation chambers, a plurality of pressure medium channels can be provided, e.g. one pressure medium channel per pressure chamber. As an alternative, it is possible to provide for one first (advance) retardation chamber to communicate with a volume accumulator via a pressure medium channel and for pressure medium to be fed to the other (advance) retardation chambers from the volume accumulator via the first (advance) retardation chamber.

Each of the pressure medium channels is assigned a check valve, wherein each of the check valves prevents a pressure medium flow from the associated pressure chamber to the volume accumulator and permits a pressure medium flow in the opposite direction when there is a suitable pressure difference upstream and downstream of the check valve. The check valves can be arranged within the pressure medium channel, for example, and can be designed as ball or plate check valves, for example. Likewise conceivable are embodiments in which a spring plate interacts with an outlet area of the associated pressure medium channel in the manner of a check valve.

The volume reservoir can communicate or be connectable to a pressure medium reservoir of the internal combustion engine by one or more pressure medium lines.

With this device, the phase position of the camshaft relative to the crankshaft can, on the one hand, be varied or maintained by means of the system pressure made available by the pressure medium pump of the internal combustion engine. On the other hand, the alternating moments acting on the camshaft can be exploited in order to bring about a phase adjustment. In this case, the proportion of the alternating moment acting counter to the direction of adjustment is absorbed, and the proportion acting in the direction of adjustment is exploited in order to increase the phase adjustment speed. The absolute value of the proportion of the alternating moment which is to be used for phase adjustment increases continuously from 0 to a maximum value and falls back to 0 in accordance with the angular position of the camshaft. During this process, the output drive element is turned relative to the input drive element in the direction of the desired phase position. On the one hand, this results in a rapid rise in the pressure in the pressure chambers to be emptied, thereby accelerating the emptying of the pressure chambers. On the other hand, the pressure medium requirement of the pressure chambers to be filled rises by the same amount. When the acting moment is small, the pressure medium requirement of the pressure chambers to be filled can be supplied by the pressure medium pump. In this case, provision can be made for the pressure medium flowing out of the pressure chambers to be emptied to fill the volume accumulator or accumulators. As the moment rises, the pressure medium requirement of the pressure chambers to be filled increases, and this can have the effect that the volume flow supplied by the pressure medium pump is not sufficient to completely fill the pressure chambers to be filled. A vacuum, which has a slowing effect on the speed of adjustment in conventional devices, thus arises in the pressure chambers to be filled. In the device according to the invention, the pressure accumulator or accumulators provided and the pressure medium channels enable the pressure medium stored in the volume accumulator or accumulators to be used to fill the pressure chambers in these phases. Owing to the pressure difference between the pressure chambers and the volume accumulator or accumulators, the check valves in the pressure medium channels open toward the pressure chambers to be filled, thus allowing pressure medium to enter the latter. Owing to the additional volume of pressure medium which is made available in the volume accumulator or accumulators and is fed during these phases to the pressure chambers to be filled, the phase adjustment speed can be increased considerably in comparison with devices which are operated exclusively by means of the system pressure made available by the pressure medium pump.

In devices in which the alternating moments are exploited in order to adjust the phase position of the camshaft relative to the crankshaft, the pressure medium which is expelled from the pressure chambers to be emptied is directed directly and under high pressure to the pressure chambers to be filled. However, only part of the pressure medium volume expelled from the pressure chambers reaches the pressure chambers to be filled. Another part is lost due to leakage. In some embodiments, losses also arise from the fact that the pressure medium is directed back into a control valve, wherein part of the pressure medium is expelled into a pressure medium reservoir of the internal combustion engine and can thus no longer reach the pressure chambers to be filled.

In these embodiments, therefore, there is insufficient pressure medium available to fill the expanding pressure chambers and hence, in turn, a vacuum arises in said pressure chambers, having a negative effect on the phase adjustment speed. Given suitable design of the volume accumulators of the device proposed, this loss is compensated by the pressure medium volume made available in the volume accumulator or accumulators, thus increasing the phase adjustment speed. At high alternating moments, the pressure medium is furthermore not directed into the pressure chambers under the high pressure generated by said moments. On the contrary, the vacuum arising in the pressure chambers to be filled is exploited in order to direct the pressure medium from the volume accumulator or accumulators into the pressure chambers. Thus, no abrupt phase changes occur and, as a result, the ability to control the device is maintained.

In an advantageous development of the invention, provision is made for the volume accumulator to be arranged within the phase adjustment unit. The stored pressure medium is thus in spatial proximity to the pressure chambers. As a result, pressure medium losses between the volume accumulator and the pressure chambers are reduced, and the response characteristics of the device are improved.

In this case, provision can be made for the volume accumulator to communicate or to be able to be connected to a pressure medium reservoir via one or more pressure medium lines, wherein the outlet area of the pressure medium channels into the volume accumulator is arranged at a greater distance from the axis of rotation of the phase adjustment unit than the outlet area of the pressure medium lines into the volume accumulator. This ensures that excess pressure medium can be carried away from the volume accumulator to the pressure medium reservoir of the internal combustion engine. Since the phase adjustment unit rotates about the axis of rotation thereof, the centrifugal force ensures that there is nevertheless pressure medium for onward transfer to the pressure chambers at the outlet areas of the pressure medium channels into the volume accumulator or accumulators.

In the case where the volume accumulator or accumulators communicate with or are connected to a pressure medium reservoir, provision can be made for the pressure medium line or lines which connect the volume accumulator to the pressure medium reservoir to be assigned a check valve, which prevents a pressure medium flow from the pressure medium reservoir to the volume accumulator and can permit a pressure medium flow in the opposite direction. If this check valve is dispensed with, the pressure prevailing in the volume accumulators is the pressure of the pressure medium reservoir, generally atmospheric pressure. By means of the check valve, the pressure level of the stored pressure medium can be raised, thereby ensuring that assistance to phase adjustment by the volume accumulator or accumulators starts even at relatively small alternating moments.

The volume accumulator or accumulators can be fed with pressure medium directly by a pressure medium pump. In this case, a pressure medium line can branch off directly from the engine oil gallery, for example, and open into the volume accumulator while bypassing the pressure chambers. For example, the pressure medium can reach the volume accumulator or accumulators via a control valve which controls the pressure medium flow to and from the pressure chambers. This ensures that the volume accumulator has an adequate supply of pressure medium at all times. As an alternative, pressure medium can be fed to the volume accumulator from the pressure chambers. During each phase adjustment, one group of pressure chambers expands at the expense of the other pressure chambers. The pressure medium flowing out of the other pressure chambers can be fed to the volume accumulator or accumulators and reused, thereby making it possible to reduce the delivery flow of the pressure medium pump. The pressure medium expelled from the pressure chambers can be directed to the volume accumulator or accumulators via a control valve which controls the pressure medium flows from and to the pressure chambers, for example.

In a development of the invention, provision is made for the device to have a control valve, by means of which the pressure medium supply from a pressure medium pump to the pressure chambers and the pressure medium discharge from the pressure chambers can be controlled.

In one specific embodiment of the invention, provision is made for the control valve to have an inlet port, a first and a second working port and at least one first volume accumulator port, wherein a first pressure medium line is provided, which communicates with the first working port, on the one hand, and opens into the advance chamber, on the other hand, wherein a second pressure medium line is provided, which communicates with the second working port, on the one hand, and opens into the retardation chamber, on the other hand, wherein a third pressure medium line is provided, which communicates with the inlet port, on the one hand, and communicates with a pressure medium pump, on the other hand, wherein at least one fourth pressure medium line is provided, which communicates with the volume accumulator port, on the one hand, and opens into the volume accumulator, on the other hand, and wherein a connection between the inlet port and the first or second working port and a connection between the volume accumulator port and the other working port can be established by means of the control valve.

In an alternative embodiment, provision is made for the control valve to have an inlet port, a first and a second working port, two volume accumulator ports and a drain port, wherein a first pressure medium line is provided, which communicates with the first working port, on the one hand, and opens into the advance chamber, on the other hand, wherein a second pressure medium line is provided, which communicates with the second working port, on the one hand, and opens into the retardation chamber, on the other hand, wherein a third pressure medium line is provided, which communicates with the inlet port, on the one hand, and with a pressure medium pump, on the other hand, wherein two fourth pressure medium lines are provided, which open into the volume accumulator, on the one hand, and each communicate with one of the volume accumulator ports, on the other hand, wherein a fifth pressure medium line is provided, which communicates with the drain port, on the one hand, and with a pressure medium reservoir, on the other hand, wherein a connection between the inlet port and the first or second working port, a connection between one of the volume accumulator ports and the other working port and a connection between the other volume accumulator port and the drain port can be established by means of the control valve.

The pressure medium flows to the pressure chambers to be filled and the pressure medium outflows from the pressure chambers to be emptied are controlled by means of a control valve which simultaneously controls the filling of the volume accumulator or accumulators from the pressure chambers to be emptied. The pressure medium flows are passed via control edges within the control valve and can be influenced through the design of the flow areas present between the control edges. The device can thus operate both in a mode in which phase adjustment is accomplished by means of the system pressure generated by the pressure medium pump and in a mode in which the alternating moment is used for phase adjustment. The changeover from one mode to the other is accomplished automatically by virtue of the fact that the delivery volume of the pressure medium pump either no longer covers or once again covers the pressure medium requirement of the pressure chambers to be filled. Phase adjustment can furthermore be controlled by means of outflow control, i.e. the adjustment speed is determined by the quantity of pressure medium flowing out of the pressure chambers and not by the quantity of pressure medium flowing to the pressure chambers to be filled. This can be achieved in a simple manner by making a flow area from the pressure chambers to the volume accumulator or accumulators or to the pressure medium reservoir smaller in all cases than a flow area from the pressure medium pump to the pressure chambers. This avoids a situation where air is sucked into the pressure chambers. Moreover, the pressure medium flow to and from the pressure chambers does not increase abruptly in accordance with a control parameter of the control valve, thus ensuring simple and stable control of the device.

The pressure medium channels, which can connect the volume accumulator or accumulators to the pressure chambers, can open directly into the corresponding pressure chambers, for example, or into the pressure medium lines which connect the working ports of the control valve to the pressure chambers.

BRIEF DESCRIPTION OF THE DRAWINGS

Further features of the invention will emerge from the following description and from the drawings, in which embodiments of the invention are illustrated in simplified form, and in which.

DETAILED DESCRIPTION OF THE PREFERRED EMBODIMENTS

Figure 1:
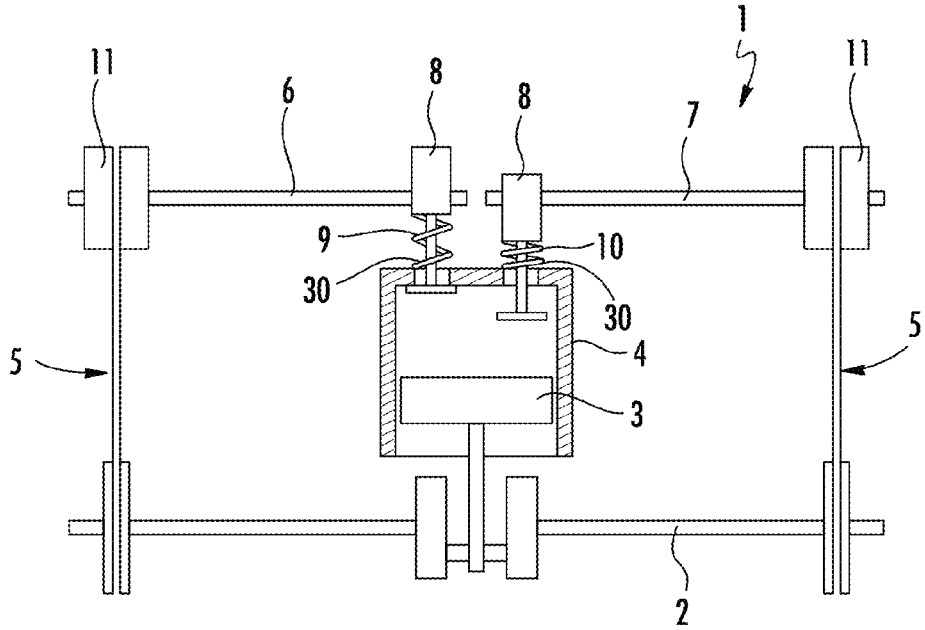
FIG. 1 shows an internal combustion engine, although only in a very schematic form.

FIG. 1 shows a sketch of an internal combustion engine 1, in which a piston 3 seated on a crankshaft 2 in a cylinder 4 is indicated. In the embodiment illustrated, the crankshaft 2 is connected to an intake camshaft 6 and an exhaust camshaft 7 by respective flexible drives 5, wherein a first and a second device 11 for variable adjustment of the timing of gas exchange valves 9, 10 of an internal combustion engine 1 can provide a relative rotation between the crankshaft 2 and the camshafts 6, 7. Cams 8 of the camshafts 6, 7 actuate one or more intake gas exchange valves 9 and one or more exhaust gas exchange valves 10, respectively. Provision can likewise be made for just one of the camshafts 6, 7 to be fitted with a device 11 or to provide just one camshaft 6, 7, which is fitted with a device 11.

Figure 2:
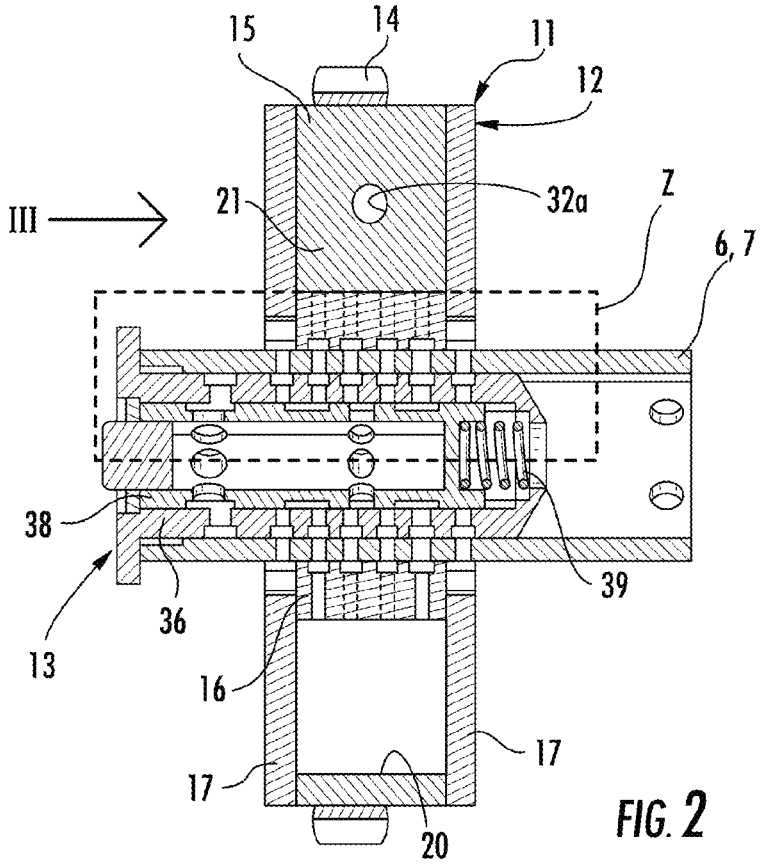
FIG. 2 shows a first embodiment of a device according to the invention in longitudinal section.
Figure 3:
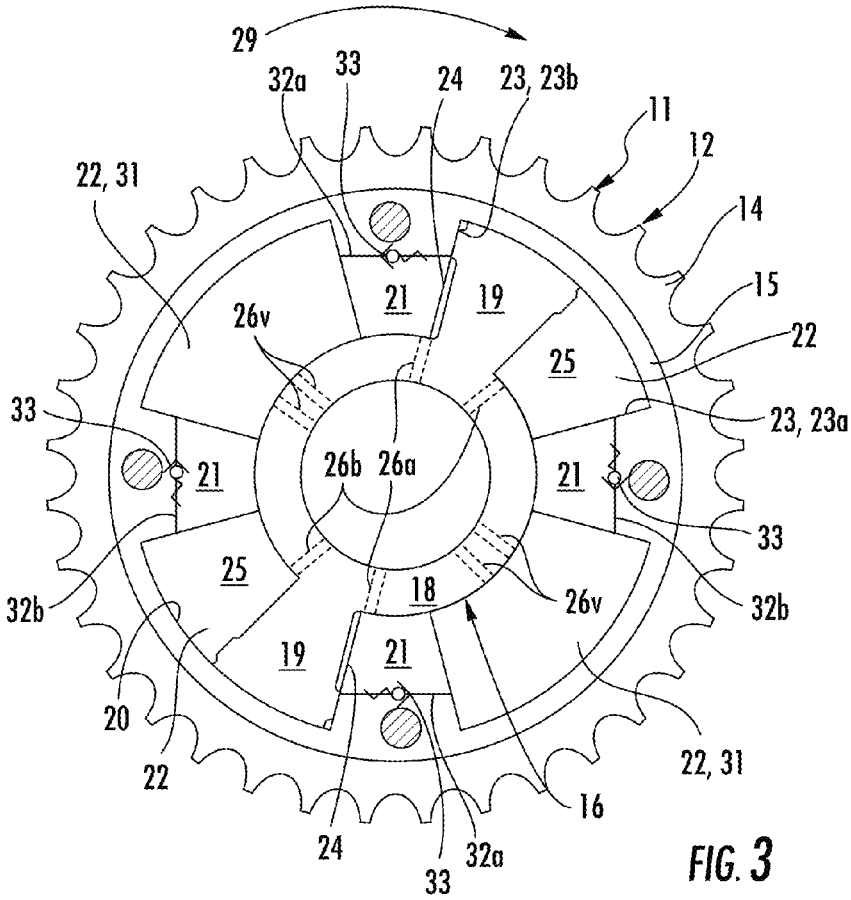
FIG. 3 shows a plan view of the phase adjustment unit from FIG. 2 in the direction of arrow III.

FIG. 2 shows a first embodiment of a device 11 according to the invention in longitudinal section. FIG. 3 shows a plan view of a phase adjustment unit 12 of the device 11, in which the side cover 17 arranged in the line of sight has been omitted.

The device 11 has a phase adjustment unit 12 and a control valve 13. The phase adjustment unit 12 has a drive input element 15 and a drive output element 16. Arranged on an outer circumferential surface of the drive input element 15 is a chain wheel 14, by means of which torque can be transmitted from the crankshaft 2 to the drive input element 15 by means of a chain drive (not shown). A side cover 17 is secured for conjoint rotation on each of the axial faces of the drive input element 15.

The drive output element 16 is in the form of a vane wheel and has a hub element 18 of substantially cylindrical construction, from the outer cylindrical circumferential surface of which, in the embodiment illustrated, two vanes 19 extend outward in the radial direction and are of integral construction with the hub element 18. A camshaft 6, 7 of hollow construction passes through a central through opening in the drive output element 16, wherein the drive output element 16 is connected to the camshaft 6, 7 by means of a press fit for conjoint rotation therewith.

Four projections 21 extend radially inward, starting from a circumferential wall 20 of the drive input element 15. In the embodiment illustrated, the projections 21 are of integral construction with the circumferential wall 20. The drive input element 15 is mounted on the drive output element 16 in such a way as to be rotatable relative to the latter by means of radially inner circumferential walls of the projections 21.

Respective pressure medium spaces 22 are formed within the phase adjustment unit 12 between in each case two projections 21 that are adjacent in the circumferential direction. Each of the pressure medium spaces 22 is delimited in the circumferential direction by opposite, substantially radially extending boundary walls 23 of adjacent projections 21, in the axial direction by the side covers 17, in the radially inward direction by the hub element 18 and in the radially outward direction by the circumferential wall 20. Respective vanes 19 project into two of the four pressure medium spaces 22, wherein the vanes 19 are designed in such a way that they rest both against the side covers 17 and also against the circumferential wall 20. Each vane 19 thus divides the respective pressure medium space 22 into two oppositely acting pressure chambers 24, 25, an advance chamber 24 and a retardation chamber 25. The other two pressure medium spaces 22, which are not divided into pressure chambers 24, 25 by a vane 19, are used as volume accumulators 31. Each of the pressure chambers 24, 25 communicates with one of the volume accumulators 31 via a pressure medium channel 32*a, b* formed in the projections 21. In this arrangement, a respective first pressure medium channel 32*a* connects a volume accumulator 31 to an advance chamber 24 and a respective second pressure medium channel 32*b* connects a volume accumulator 31 to a retardation chamber 25. Each pressure medium channel 32*a, b* is assigned a first check valve 33, which prevents a pressure medium flow from the respective pressure chamber 24, 25 to the respective volume accumulator 31 and permits a pressure medium flow from the volume accumulator 31 to the respective pressure chamber 24, 25 as soon as a defined pressure difference prevails between the pressure chamber 24, 25 and the volume accumulator 31. The first check valves 33 can be arranged within the pressure medium channels 32*a, b*, for example, and can be designed as ball check valves.

The drive output element 16 is accommodated in the drive input element 15 and is mounted in such a way as to be rotatable relative to the latter within a defined angular range. In one direction of rotation of the drive output element 16, the angular range is limited by the fact that the vanes 19 come to rest against a respective corresponding boundary wall 23 (advance stop 23*a*) of the associated pressure medium spaces 22. Similarly, the angular range in the other direction of rotation is limited by the fact that the vanes 19 come to rest against the other boundary walls 23 of the associated pressure medium spaces 22, which serve as a retardation stop 23*b*.

By supplying pressure to the advance chambers 24 while simultaneously allowing pressure medium to flow out of the retardation chambers 25, the phase position of the drive output element 16 relative to the drive input element 15 can be adjusted in the direction of earlier timing. In this case, the drive output element 16 is turned relative to the drive input element 15 in the direction of rotation of the device 11, indicated by the arrow 29.

By supplying pressure to the retardation chambers 25 while simultaneously allowing pressure medium to flow out of the advance chambers 24, the phase position of the drive output element 16 relative to the drive input element 15 can be adjusted in the direction of later timing. In this case, the drive output element 16 is turned relative to the drive input element 15 counter to the direction of rotation 29 of the device 11.

By supplying pressure to both groups of pressure chambers 24, 25, the phase position can be held constant. As an alternative, provision can be made to supply none of the pressure chambers 24, 25 with pressure medium during phases in which the phase position is constant. The lubricating oil of the internal combustion engine 1 is generally used as the hydraulic pressure medium.

Figure 4:
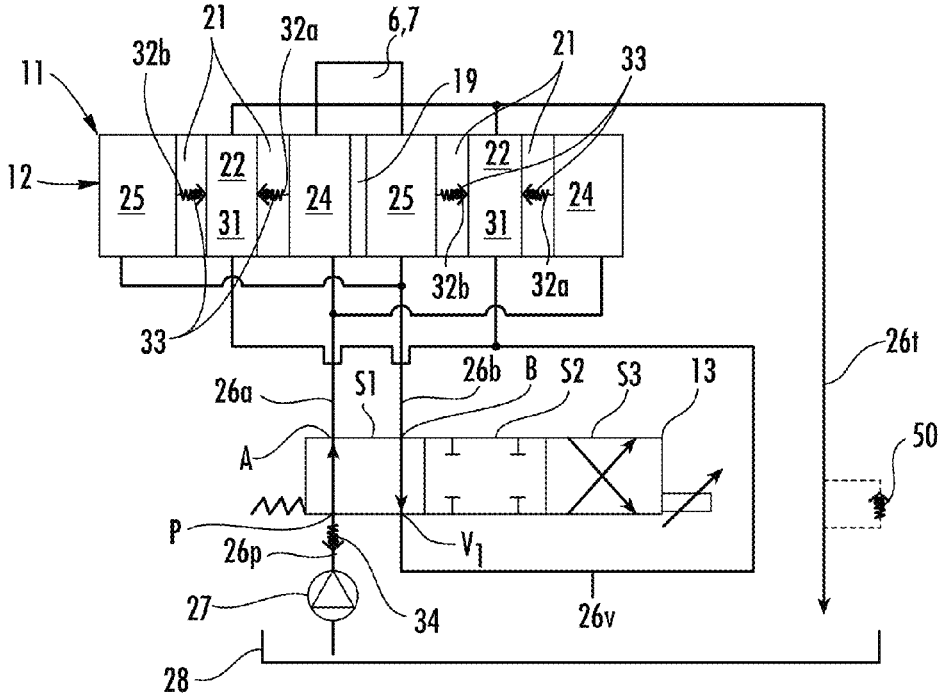
FIG. 4 shows a schematic illustration of the device from FIG. 2, FIGS. 5 and 6 each show an enlarged illustration of the detail Z from FIG. 2, FIGS. 7 and 8 show a second embodiment of a device according to the invention similar to the illustration in FIGS. 5 and 6.

Pressure medium is supplied to and discharged from the pressure chambers 24, 25 by means of a hydraulic circuit, which is illustrated in FIG. 4 and is controlled by means of the control valve 13. The control valve 13 has an inlet port P, a volume accumulator port $V_1$ and two working ports A, B. The hydraulic circuit has five pressure medium lines 26*a, b, p, v, t*. The first pressure medium line 26*a* communicates with the first working port A, on the one hand, and opens into the advance chambers 24, on the other hand. The second pressure medium line 26*b* communicates with the second working port B, on the one hand, and opens into the retardation chambers 25, on the other hand. The third pressure medium line 26*p* connects a pressure medium pump 27 to the inlet port P, wherein a second check valve 34 prevents a pressure medium flow from the control valve 13 to the pressure medium pump 27 and can permit a pressure medium flow in the opposite direction. The fourth pressure medium line 26*v* communicates with the volume accumulator port $V_1$, on the one hand, and opens into the volume accumulators 31, on the other hand. The fifth pressure medium line 26*t* opens into the volume accumulators 31, on the one hand, and into a pressure medium reservoir 28, e.g. an oil sump of the internal combustion engine 1, on the other hand. In this case, the fifth pressure medium line can open directly the pressure medium reservoir 28 (solid line in FIG. 4) or via a third check valve 50 (dashed line in FIG. 4).

The control valve 13 can assume three control positions S1-S3. In the first control position S1, the inlet port P is connected to the first working port A, and the second working port B is connected to the volume accumulator port $V_1$. In the second control position S2, there is no connection between the working ports A, B, on the one hand, and the inlet port P and the volume accumulator port $V_1$, on the other hand. In the third control position S3, the inlet port P is connected to the second working port B, and the first working port A is connected to the volume accumulator port $V_1$.

During the operation of the internal combustion engine 1, the camshaft 6, 7 rotates about the longitudinal axis thereof. During this process, each gas exchange valve 9, 10 is opened periodically by means of a cam 8, counter to the force of a valve spring 30 (FIG. 1), and closed again. During the opening phase of the gas exchange valve 9, 10 (rising cam 8), the camshaft 6, 7 is acted upon by a braking torque, which corresponds to the vector product of the force of the valve spring 30 and the lever arm of the cam 8. During the closing of the gas exchange valve 9, 10 (falling cam), the camshaft 6, 7 is acted upon by an accelerating torque, which corresponds to the vector product of the force of the valve spring 30 and the lever arm of the cam 8. The camshaft 6, 7 is thus acted upon by a periodic alternating moment. The alternating moment has the effect that, in the case of the rising cam 8, the vanes 19 are urged counter to the direction of rotation 29 of the phase adjustment unit 12. As a result, the pressure in the advance chambers 24 is increased, and the pressure in the retardation chambers 25 is lowered. In the case of the falling cam 8, the vanes 19 are urged in the direction of rotation 29 of the phase adjustment unit 12, as a result of which the pressure in the advance chambers 24 falls and the pressure in the retardation chambers 25 rises.

During the operation of the internal combustion engine 1, two states can thus occur. In a first operating state, the system pressure produced within the hydraulic circuit by the pressure medium pump 27 exceeds the pressure produced in the pressure chambers 24, 25 by the alternating moments acting on the camshaft 6, 7. In a second operating state, the pressure peaks produced in the pressure chambers 24, 25 by the alternating moments exceed the system pressure made available by the pressure medium pump 27.

If a phase adjustment in the direction of earlier timing is demanded, the control valve 13 assumes the first control position S1. In operating phases in which the operating pressure delivered by the pressure medium pump 27 exceeds the pressure level generated by the alternating moment in the pressure chambers 24, 25, the pressure medium delivered by the pressure medium pump 27 passes via the third pressure medium line 26*p*, the inlet port P, the first working port A and the first pressure medium line 26*a* to the advance chambers 24. As a result, the vanes 19 within the respective pressure medium spaces 22 are moved in the direction of rotation 29 of the phase adjustment unit 12. At the same time, pressure medium is displaced from the retardation chambers 25, via the second pressure medium line 26*b*, the second working port B, the volume accumulator port $V_1$ and the fourth pressure medium line 26*v*, into the volume accumulators 31. The volume of thus urged 31. The volume of the advance chambers 24 thus increases at the expense of the retardation chambers 25, and the vanes 19 are moved in the direction of rotation 29 of the phase adjustment unit 12. As a result, the camshaft 6, 7 is turned relative to the crankshaft 2 in the direction of earlier timing. The volume accumulators 31 are filled by the pressure medium flowing out of the retardation chambers 25 and excess pressure medium is expelled into the pressure medium reservoir 28 via the fifth pressure medium line 26*t* against atmospheric pressure or the third check valve 50. The pressure level prevailing both in the advance chambers 24 and in the retardation chambers 25 is thus higher than in the volume accumulators 31, as a result of which the first check valves 33 prevent a pressure medium flow from the volume accumulators 31 into the pressure chambers 24, 25.

In operating phases in which the pressure level generated by the alternating moment in the pressure chambers 24, 25 exceeds the operating pressure delivered by the pressure medium pump 27, a distinction must be drawn between two cases: an assisting moment acting in the direction of adjustment and a moment acting counter to the direction of adjustment.

In the case of an assisting moment, the camshaft 6, 7 is accelerated, and the vanes 19 are thus moved in the direction of the advance stop 23*a*. This results in a pressure drop in the advance chambers 24 and an increase in the pressure in the retardation chambers 25. The pressure prevailing in the retardation chambers 25 is thus higher than in the advance chambers 24, and indeed the pressure in the advance chambers 24 can fall below atmospheric pressure. Pressure medium is thus fed from the retardation chambers 25, via the second pressure medium line 26*b*, the second working port B, the volume accumulator port $V_1$ and the fourth pressure medium line 26*v*, to the volume accumulators 31. Owing to the fifth pressure medium line 26*t* opening into the pressure medium reservoir 28, atmospheric pressure prevails in the volume accumulators 31 or, in embodiments in which a third check valve 50 is provided in the fifth pressure medium line 26*t*, a higher pressure level defined by the third check valve 50 prevails, although this is lower than the pressure level within the retardation chambers 25. Owing to the higher pressure level in the retardation chambers 25, the first check valves 33, which connect the volume accumulators 31 to the retardation chambers 25, block a pressure medium flow from the volume accumulators 31 into the retardation chambers 25. At the same time, pressure medium passes from the pressure medium pump 27, via the inlet port P, the first working port A and the first pressure medium line 26*a*, to the advance chambers 24. If the pressure medium requirement of the pressure chambers 24 to be filled exceeds the volume flow supplied by the pressure medium pump 27, the pressure in the advance chambers 24 falls below the pressure prevailing in the volume accumulators 31. The first check valves 33 thus allow a pressure medium flow from the volume accumulators 31 to the advance chambers 24 through the first pressure medium channels 32*a*. Since the outlet points of the pressure medium channels 32*a, b* into the volume accumulators 31 are at a greater distance from the axis of rotation of the phase adjustment unit 12 in the radial direction than the outlet points of the fifth pressure medium line 26*t*, the centrifugal forces prevailing in the rotating device 11 ensure that no air is sucked into the advance chambers 24. At the same time, the volume accumulators 31 are continuously replenished during this process by the pressure medium flowing out of the retardation chambers 25. In comparison with conventional devices 11, the advance in the case of a moment with an assisting action is thus assisted by a pressure medium volume stored in the volume accumulators 31. Compared with devices 11 in which the pressure medium emerging from the retardation chambers 25 is directed to the inlet port P of the control valve 13 and passes from there to the advance chambers 24, there is the advantage that leakage losses are compensated or even overcompensated by the pressure medium volume already present in the volume accumulators 31. The phase adjustment speed is thus increased in a reliable manner.

In the case of a moment acting counter to the direction of adjustment, the camshaft 6, 7 is acted upon by a braking moment, as a result of which the vanes 19 are urged in the direction of the retardation stop 23*b*. The pressure in the advance chambers 24 thus rises, and the pressure medium is hindered from leaving the advance chambers 24 by the second check valve 34 and the first check valves 33. As a result, the vanes 19 are held in position, with the result that the pressure in the retardation chambers 25 does not drop and thus does not fall below the pressure prevailing in the volume accumulators 31. The first check valves 33 thus prevent a pressure medium flow from the volume accumulators 31 to the retardation chambers 25. As a consequence, there is no reverse rotation of the device 11 in the case of a moment directed counter to the phase adjustment direction; on the contrary, the current phase position is maintained.

If a phase adjustment in the direction of later timing is demanded, the control valve 13 assumes the third control position S3. In operating phases in which the operating pressure delivered by the pressure medium pump 27 exceeds the pressure level generated by the alternating moment in the pressure chambers 24, 25, the pressure medium delivered by the pressure medium pump 27 passes via the third pressure medium line 26*p*, the inlet port P, the second working port B and the second pressure medium line 26*b* to the retardation chambers 25. As a result, the vanes 19 are moved within the respective pressure medium spaces 22 counter to the direction of rotation 29 of the phase adjustment unit 12. At the same time, pressure medium is forced out of the advance chambers 24, via the first pressure medium line 26*a*, the first working port A, the volume accumulator port $V_1$ and the fourth pressure medium line 26*v*, into the volume accumulators 31. The volume of the retardation chambers 25 thus increases at the expense of the advance chambers 24, and the vanes 19 are moved counter to the direction of rotation 29 of the phase adjustment unit 12. As a result, the camshaft 6, 7 is turned relative to the crankshaft 2 in the direction of later timing. The volume accumulators 31 are filled by the pressure medium flowing out of the advance chambers 24, and excess pressure medium is expelled via the fifth pressure medium line 26*t* into the pressure medium reservoir 28 against atmospheric pressure or the third check valve 50. The pressure level prevailing both in the advance chambers 24 and in the retardation chambers 25 is thus higher than in the volume accumulators 31, as a result of which the first check valves 33 prevent a pressure medium flow from the volume accumulators 31 into the pressure chambers 24, 25.

In operating phases in which the pressure level generated by the alternating moment in the pressure chambers 24, 25 exceeds the operating pressure delivered by the pressure medium pump 27, a distinction must once again be drawn between an assisting moment acting in the direction of adjustment and a moment acting counter to the direction of adjustment.

In the case of an assisting moment, the camshaft 6, 7 is braked, and the vanes 19 are thus moved in the direction of the retardation stop 23*a*. This results in a pressure drop in the retardation chambers 25 and an increase in the pressure in the advance chambers 24. The pressure prevailing in the advance chambers 24 is thus higher than in the retardation chambers 25, and indeed the pressure in the retardation chambers 25 can fall below atmospheric pressure. Pressure medium is thus fed from the advance chambers 24, via the first pressure medium line 26*a*, the first working port A, the volume accumulator port $V_1$ and the fourth pressure medium line 26*v*, to the volume accumulators 31. Owing to the fifth pressure medium line 26*t* opening into the pressure medium reservoir 28, atmospheric pressure prevails in the volume accumulators 31 or, in embodiments in which a third check valve 50 is provided in the fifth pressure medium line 26*t*, a higher pressure level defined by the third check valve 50 prevails, although this is lower than the pressure level within the retardation chambers 25. Owing to the higher pressure level in the advance chambers 24, the first check valves 33, which connect the volume accumulators 31 to the advance chambers 24, block a pressure medium flow from the volume accumulators 31 into the advance chambers 24.

At the same time, pressure medium passes from the pressure medium pump 27, via the inlet port P, the second working port B and the second pressure medium line 26*b*, to the retardation chambers 25. If the pressure medium requirement of the pressure chambers 25 to be filled exceeds the volume flow supplied by the pressure medium pump 27, the pressure in the retardation chambers 25 falls below the pressure prevailing in the volume accumulators 31. The first check valves 33 thus allow a pressure medium flow from the volume accumulators 31 to the retardation chambers 25 through the second pressure medium channels 32*b*. Since the outlet points of the pressure medium channels 32*a, b* into the volume accumulators 31 are at a greater distance from the axis of rotation of the phase adjustment unit 12 in the radial direction than the outlet points of the fifth pressure medium line 26*t*, the centrifugal forces prevailing in the rotating device 11 ensure that no air is sucked into the retardation chambers 25. At the same time, the volume accumulators 31 are continuously replenished during this process by the pressure medium flowing out of the retardation chambers 25.

In comparison with conventional devices 11, the retardation in the case of a moment with an assisting action is thus assisted by a pressure medium volume stored in the volume accumulators 31. Compared with devices 11 in which the pressure medium emerging from the advance chambers 24 is directed to the inlet port P of the control valve 13 and passes from there to the retardation chambers 25, there is the advantage that leakage losses are compensated or even overcompensated by the pressure medium volume already present in the volume accumulators 31. The phase adjustment speed is thus increased in a reliable manner.

In the case of a moment acting counter to the direction of adjustment, the camshaft 6, 7 is accelerated, and the vanes 19 are thus urged in the direction of the advance stop 23*a*. The pressure in the retardation chambers 25 thus rises, and the pressure medium is hindered from leaving the retardation chambers 25 by the second check valve 34 and the first check valves 33. As a result, the vane 19 is held in position, with the result that the pressure in the advance chambers 24 does not drop and thus does not fall below the pressure prevailing in the volume accumulators 31. The first check valves 33 thus prevent a pressure medium flow from the volume accumulators 31 to the advance chambers 24. As a consequence, there is no reverse rotation of the device 11 in the case of a moment directed counter to the phase adjustment direction; on the contrary, the current phase position is maintained.

If the current phase position is to be maintained, the control valve 13 assumes the second control position S2. In this control position, the working ports A, B are closed. Thus the pressure medium delivered to the inlet port P by the pressure medium pump 27 does not reach either of the working ports A, B. Similarly, no pressure medium flows out of the pressure chambers 24, 25 to the volume accumulator port $V_1$. When pressure peaks caused by the alternating moment acting on the camshaft 6, 7 occur in the pressure chambers 24, 25, pressure medium is prevented from leaving the pressure chambers 24, 25 by the closed working ports A, B. The vanes 19 are thus clamped hydraulically between the pressure chambers 24, 25 and, as a result, the current phase position is maintained. At the same time, it is ensured that the pressure prevailing in the pressure chambers 24, 25 exceeds the pressure prevailing in the volume accumulators 31, and, as a result, a pressure medium flow from the volume accumulators 31 into the pressure chambers 24, 25 via the pressure medium channels 32*a, b* is prevented.

Figure 5:
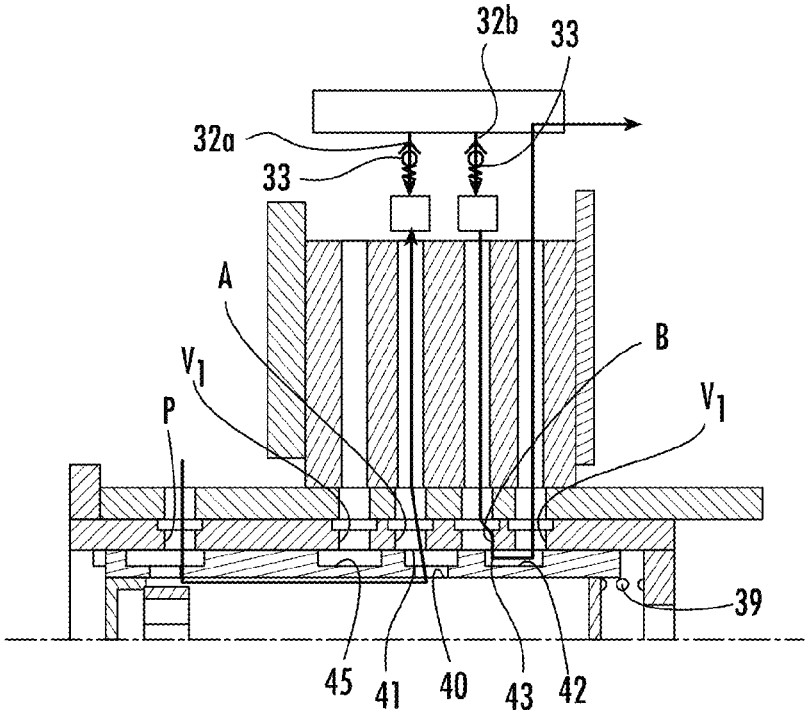
Figure 6:
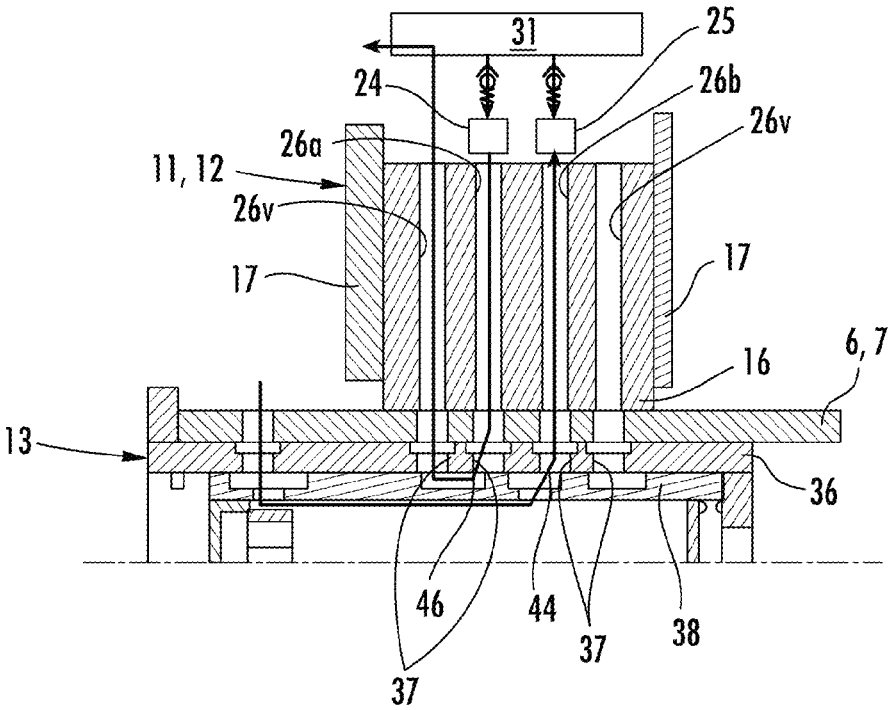

FIGS. 5 and 6 show the detail Z from FIG. 2 in an enlarged view, wherein the control valve 13 is illustrated in the first (FIG. 5) and the third control position S3 (FIG. 6) respectively. The first and the second pressure medium line 26*a, b* are designed as radial holes within the drive output element 16 that are offset axially relative to one another. In this embodiment, two fourth pressure medium lines 26*v* are provided, which are likewise designed as radial holes within the drive output element 16 that are offset axially relative to one another. The first, the second and the fourth pressure medium lines 26*a, b, v* are arranged offset relative to one another in the circumferential direction of the drive output element 16 (see FIG. 3), but are shown in one plane in FIGS. 5 and 6 for the sake of clarity. At one end, the first, the second and the fourth pressure medium lines 26*a, b, v* open into the advance chambers 24, the retardation chambers 25 and the volume accumulators 31, respectively. The other ends of the pressure medium lines 26*a, b, v* open into radial holes in the camshaft 6, 7, which in turn communicate respectively with the first working port A, the second working port B and two volume accumulator ports $V_1$ of the control valve 13, which are designed as radial openings 37 in a valve housing 36 of the control valve 13. Arranged within the valve housing 36 is a control plunger 38, which can be moved in the axial direction within the valve housing 36 in the axial direction within the valve housing 36 by means of an actuating unit (not shown), against the force of a spring 39 a spring 39. The control plunger 38 can be moved into and held in any position between the position illustrated in FIG. 5 and that illustrated in FIG. 6.

When the control valve 13 is in the first control position S1 (FIG. 5), pressure medium enters the interior of the valve housing 36 via the inlet port P and progresses into the interior of the control plunger 38. From there, the pressure medium passes via a plunger opening 40 to the first working port A. During this process, the pressure medium passes a first control area 41, which is defined by the overlap between the plunger opening 40 and the radial opening 37 of the first working port A. From the first working port A, the pressure medium passes via the first pressure medium line 26*a* to the advance chambers 24. At the same time, pressure medium passes out of the retardation chambers 25, via the second pressure medium line 26*b*, to the second working port B. This port is connected by a first annular groove 42 formed on the outer circumferential surface of the control plunger 38 to the volume accumulator port $V_1$. On the way from the second working port B to the volume accumulator port $V_1$, the pressure medium passes a second control area 43, which is defined by the overlap between the radial opening 37 of the second working port B and the first annular groove 42. In the embodiment illustrated, the second control area 43 is made smaller than the first control area 41 (outflow control). The flow out of the retardation chambers 25 is thus restricted relative to the flow to the advance chambers 24, thereby ensuring that the pressure chambers 24, 25 are always completely filled during the operation of the internal combustion engine 1.

The first control position S1 can be achieved by a large number of positions of the control plunger 38 relative to the valve housing 36. At the same time, the control plunger 38 must be in a position in which pressure medium can pass from the inlet port P to the first working port A and pressure medium can pass from the second working port B to the volume accumulator port $V_1$. In this case, the first and the second control area 41, 43 and, in corresponding fashion, the pressure medium flow to and from the pressure chambers 24, 25 become larger, the further the control plunger 38 moves toward the position illustrated in FIG. 5.

When the control valve 13 is in the third control position S3 (FIG. 6), pressure medium enters the interior of the valve housing 36 via the inlet port P and progresses into the interior of the control plunger 38. From there, the pressure medium passes via the plunger opening 40 to the second working port B. During this process, the pressure medium passes a third control area 44, which is defined by the overlap between the plunger opening 40 and the radial opening 37 of the second working port B. From the second working port B, the pressure medium passes via the second pressure medium line 26*b* to the retardation chambers 25. At the same time, pressure medium passes out of the advance chambers 24, via the first pressure medium line 26*a*, to the first working port A. This port is connected by a second annular groove 45 formed on the outer circumferential surface of the control plunger 38 to the volume accumulator port $V_1$. On the way from the first working port A to the volume accumulator port $V_1$, the pressure medium passes a fourth control area 46, which is defined by the overlap between the radial opening 37 of the first working port A and the second annular groove 45. In the embodiment illustrated, the fourth control area 46 is made smaller than the third control area 44 (outflow control). The flow out of the advance chambers 24 is thus restricted relative to the flow to the retardation chambers 25, thereby ensuring that the pressure chambers 24, 25 are always completely filled during the operation of the internal combustion engine 1.

The third control position S3 can be achieved by a large number of positions of the control plunger 38 relative to the valve housing 36. At the same time, the control plunger 38 must be in a position in which pressure medium can pass from the inlet port P to the second working port B and pressure medium can pass from the first working port A to the volume accumulator port $V_1$. The third and the fourth control area 44, 46 and, in corresponding fashion, the pressure medium flow to and from the pressure chambers 24, 25 become larger and larger the further the control plunger 38 moves toward the position illustrated in FIG. 6.

Figure 7:
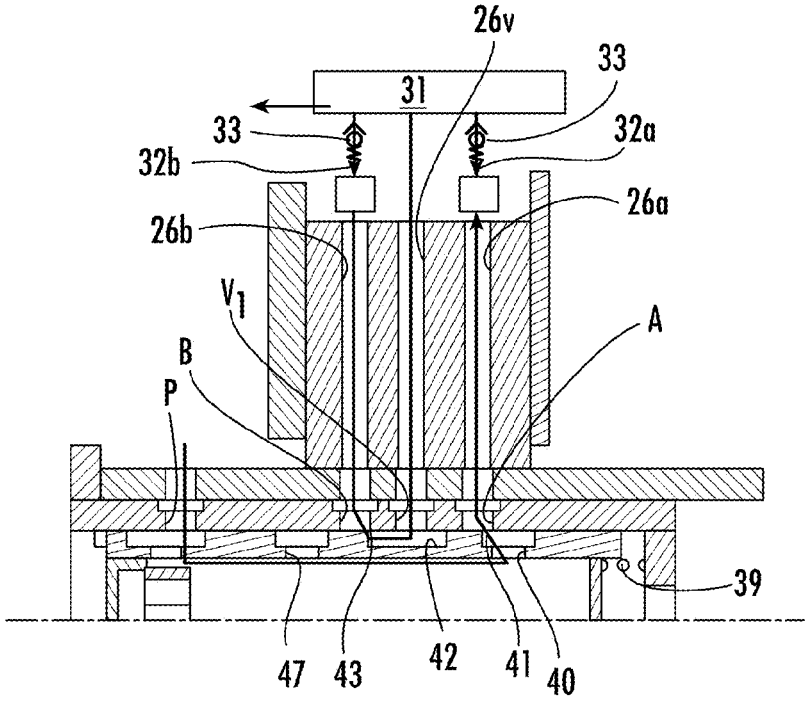
Figure 8:
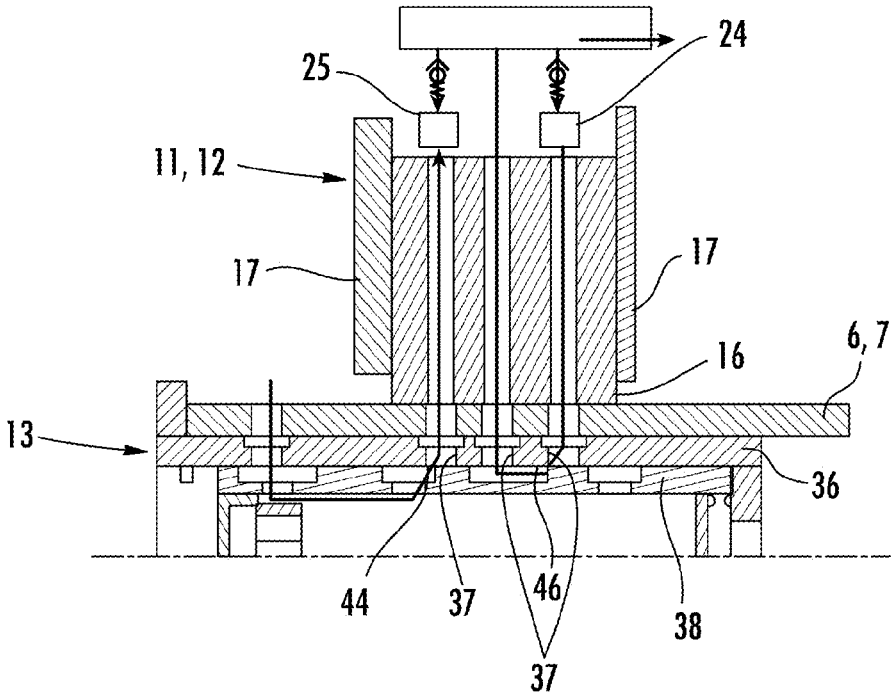

FIGS. 7 and 8 show a second embodiment similar to the illustrations in FIGS. 5 and 6. This embodiment is very largely identical with the first embodiment and therefore only the differences are explained below. In the second embodiment, just one fourth pressure medium line 26*v* is provided, which communicates with the volume accumulators 31, on the one hand, and with the single volume accumulator port $V_1$, on the other hand. The fourth pressure medium line 26*v* is arranged between the first and the second pressure medium line 26*a, b* in the axial direction.

The control plunger 38 has two plunger openings 40, 47 and an annular groove 42 on the outer circumferential surface thereof, wherein the plunger openings 40, 47 and the annular groove 42 are spaced apart in the axial direction. The annular groove 42 is arranged between the plunger openings 40, 47.

When the control valve 13 is in the first control position S1 (FIG. 7), pressure medium enters the interior of the valve housing 36 via the inlet port P and progresses into the interior of the control plunger 38. From there, the pressure medium passes via the first plunger opening 40 to the first working port A. During this process, the pressure medium passes a first control area 41, which is defined by the overlap between the first plunger opening 40 and the radial opening 37 of the first working port A. From the first working port A, the pressure medium passes via the first pressure medium line 26*a* to the advance chambers 24. At the same time, pressure medium passes out of the retardation chambers 25, via the second pressure medium line 26*b*, to the second working port B. This port is connected by the annular groove 42 to the volume accumulator port $V_1$. On the way from the second working port B to the volume accumulator port $V_1$, the pressure medium passes a second control area 43, which is defined by the overlap between the radial opening 37 of the second working port B and the annular groove 42. In the embodiment illustrated, the second control area 43 is made smaller than the first control area 41 (outflow control). The flow out of the retardation chambers 25 is thus restricted relative to the flow to the advance chambers 24, thereby ensuring that the pressure chambers 24, 25 are always completely filled during the operation of the internal combustion engine 1.

When the control valve 13 is in the third control position S3 (FIG. 8), pressure medium enters the interior of the valve housing 36 via the inlet port P and progresses into the interior of the control plunger 38. From there, the pressure medium passes via the second plunger opening 47 to the second working port B. During this process, the pressure medium passes a third control area 44, which is defined by the overlap between the second plunger opening 47 and the radial opening 37 of the second working port B. From the second working port B, the pressure medium passes via the second pressure medium line 26*b* to the retardation chambers 25. At the same time, pressure medium passes out of the advance chambers 24, via the first pressure medium line 26*a*, to the first working port A. This port is connected by the annular groove 42 to the volume accumulator port $V_1$. On the way from the first working port A to the volume accumulator port $V_1$, the pressure medium passes a fourth control area 46, which is defined by the overlap between the radial opening 37 of the first working port A and the annular groove 42. In the embodiment illustrated, the fourth control area 46 is made smaller than the third control area 44 (outflow control). The flow out of the advance chambers 24 is thus restricted relative to the flow to the retardation chambers 25, thereby ensuring that the pressure chambers 24, 25 are always completely filled during the operation of the internal combustion engine 1.

Figure 9:
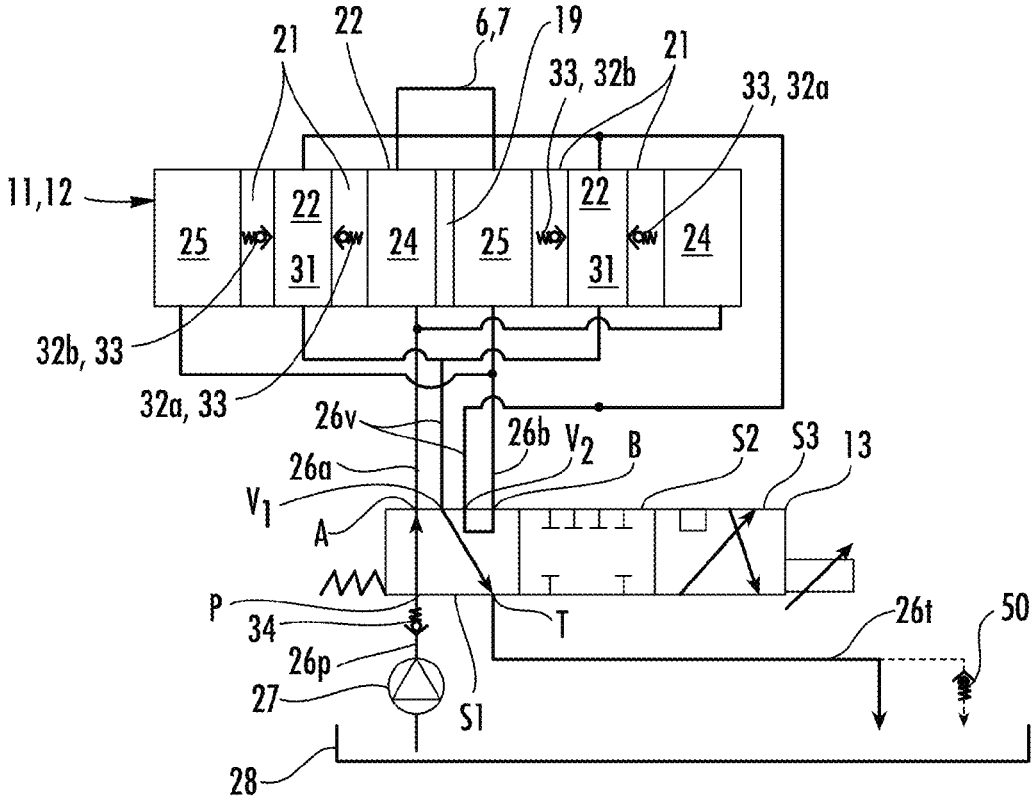
FIG. 9 shows a schematic illustration of a third device according to the invention similar to the illustration in FIG. 4, and FIGS. 10 and 11 show an illustration of the third embodiment of a device similar to the illustration in FIGS. 5 and 6.

FIG. 9 shows another embodiment of a device 11 according to the invention. The third embodiment is largely identical with the first two embodiments and therefore only the differences are explained below. In contrast to the first two embodiments, the control valve 13 has two volume accumulator ports $V_1$, $V_2$ and an additional drain port T. Each volume accumulator port $V_1$, $V_2$ is connected to the volume accumulators 31 by a respective fourth pressure medium line 26*v*. The drain port T is connected to the pressure medium reservoir 28 by means of the fifth pressure medium line 26*t*.

Once again, the control valve 13 can assume three control positions S1-S3. In the first control position S1, the inlet port P is connected to the first working port A, the second working port B is connected to the second volume accumulator port $V_2$, and the first volume accumulator port $V_1$ is connected to the drain port T. In the second control position S2, there is no connection between the working ports A, B, on the one hand, and the inlet port P and the volume accumulator ports $V_1$, $V_2$, on the other hand. In the third control position S3, the inlet port P is connected to the second working port B, the first working port A is connected to the first volume accumulator port $V_1$, and the second volume accumulator port $V_2$ is connected to the drain port T.

Figure 10:
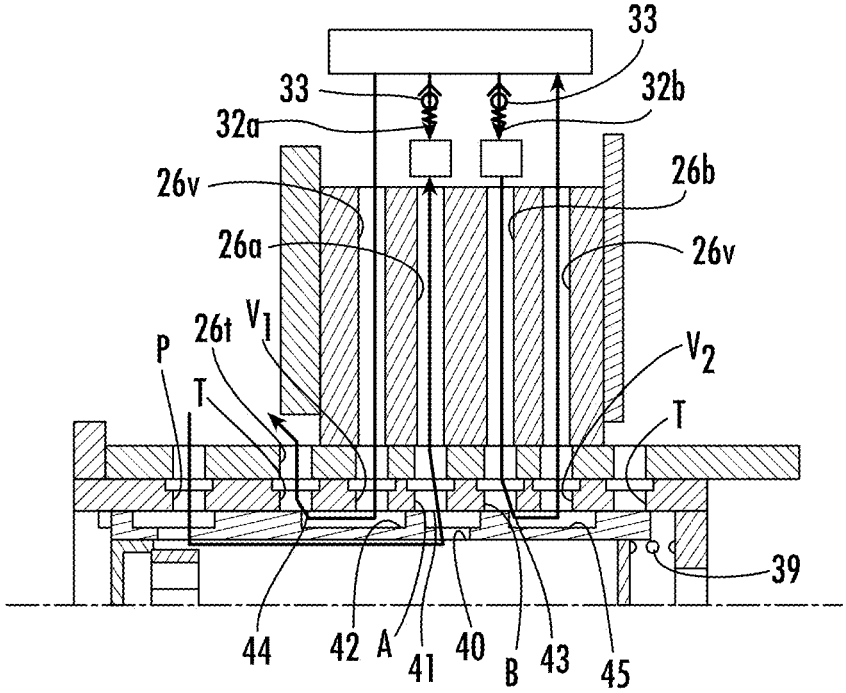
Figure 11:
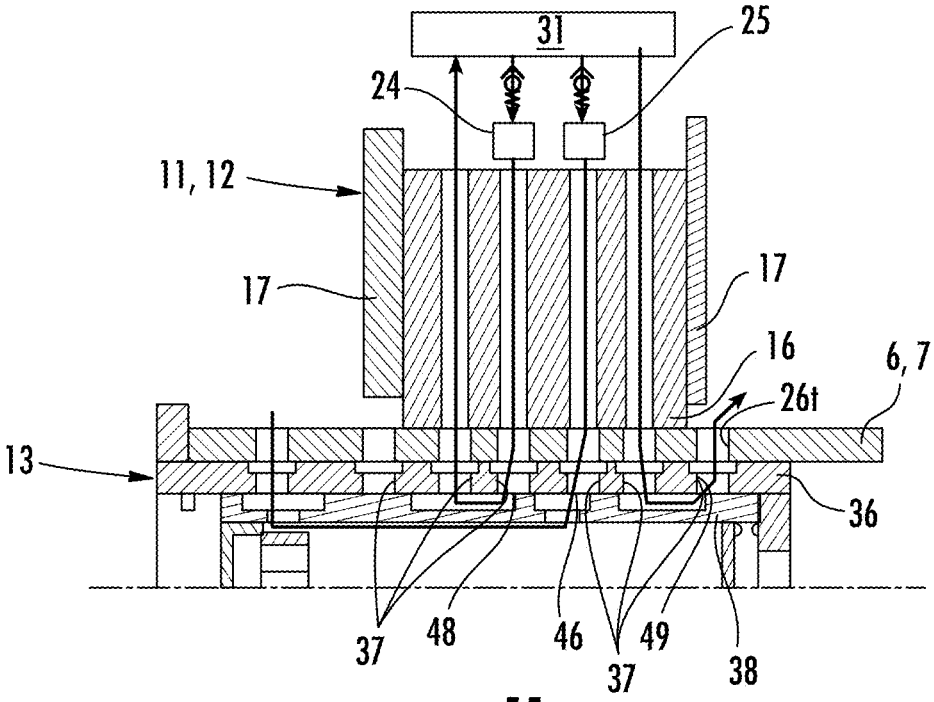

FIGS. 10 and 11 show the control valve 13 of the third embodiment and the associated pressure medium lines 26*a, b, v, t*.

The first, the second and the two fourth pressure medium lines 26*a, b, v* are once again designed as radial holes within the drive output element 16 that are offset axially relative to one another. The first and second pressure medium lines 26*a, b* once again open into the corresponding pressure chambers 24, 25 and are connected to the working ports A, B. The fourth pressure medium lines 26*v* open into the volume accumulators 31 and are each connected to one of the volume accumulator ports $V_1$, $V_2$. The fifth pressure medium line 26*t* is embodied as a radial opening 37 in the camshaft 6, 7 and communicates with the drain port T and the pressure medium reservoir 28. Arranged within the valve housing 36 there is once again a control plunger 38 that can be positioned in the axial direction relative to the valve housing 36. The control plunger 38 is provided with a radial plunger opening 40, which is arranged between two annular grooves 42, 45 formed on the outer circumferential surface of the control plunger 38.

When the control valve 13 is in the first control position S1 (FIG. 10), pressure medium enters the interior of the valve housing 36 via the inlet port P and progresses into the interior of the control plunger 38. From there, the pressure medium passes via the plunger opening 40 to the first working port A. During this process, the pressure medium passes a first control area 41, which is defined by the overlap between the plunger opening 40 and the radial opening 37 of the first working port A. From the first working port A, the pressure medium passes via the first pressure medium line 26*a* to the advance chambers 24. At the same time, pressure medium passes out of the retardation chambers 25, via the second pressure medium line 26*b*, to the second working port B. This port is connected by a second annular groove 45 to the second volume accumulator port $V_2$. On the way from the second working port B to the second volume accumulator port $V_2$, the pressure medium passes a second control area 43, which is defined by the overlap between the radial opening 37 of the second working port B and the second annular groove 45. Once the volume accumulators 31 are completely filled, pressure medium passes out of the volume accumulators 31, via the fourth pressure medium line 26*v*, to the first volume accumulator port $V_1$, which is connected by the first annular groove 42 to the drain port T. During this process, the pressure medium passes a third control area 44, which is defined by the overlap between the radial opening 37 of the first volume accumulator port $V_1$ and the first annular groove 42. In the embodiment illustrated, the third control area 44 is made smaller than the second control area 43 and smaller than the first control area 41. The flow out of the retardation chambers 25 is thus restricted relative to the flow to the advance chambers 24, and hence outflow control is achieved in this embodiment too. At the same time, the inlet flow to the volume accumulators 31 is unrestricted in comparison with the first two embodiments, thereby ensuring that the pressure medium enters said accumulators at a higher pressure.

When the control valve 13 is in the third control position S3 (FIG. 11), pressure medium enters the interior of the valve housing 36 via the inlet port P and progresses into the interior of the control plunger 38. From there, the pressure medium passes via the plunger opening 40 to the second working port B. During this process, the pressure medium passes a fourth control area 46, which is defined by the overlap between the plunger opening 40 and the radial opening 37 of the second working port B. From the second working port B, the pressure medium passes via the second pressure medium line 26*b* to the retardation chambers 25. At the same time, pressure medium passes out of the advance chambers 24, via the first pressure medium line 26*a*, to the first working port A. This port is connected by the first annular groove 42 to the first volume accumulator port $V_1$. During this process, the pressure medium passes a fifth control area 48, which is defined by the overlap between the radial opening 37 of the first working port A and the first annular groove 42. Once the volume accumulators 31 are completely filled, pressure medium passes out of the volume accumulators 31, via the fourth pressure medium line 26*v*, to the second volume accumulator port $V_2$, which is connected by the second annular groove 42 to the drain port T. During this process, the pressure medium passes a sixth control area 49, which is defined by the overlap between the radial opening 37 of the second volume accumulator port $V_2$ and the second annular groove 45. In the embodiment illustrated, the sixth control area 49 is made smaller than the fourth control area 46 and smaller than the fifth control area 48. The flow out of the advance chambers 24 is thus restricted relative to the flow to the retardation chambers 25, and hence outflow control is achieved in this embodiment too. At the same time, the inlet flow to the volume accumulators 31 is unrestricted in comparison with the first two embodiments, thereby ensuring that the pressure medium enters said accumulators at a higher pressure.

The third embodiment operates in a manner similar to the first two embodiments.

The devices 11 presented are distinguished by significantly increased phase adjustment speeds. Moreover, the outflow control achieved ensures that there are no major changes in the flow of pressure medium to the pressure chambers 24, 25 to be filled in the case of small movements of the control plunger 38, thereby considerably facilitating control of the phase position. Another advantage is that the positions of the control plunger 38 relative to the valve housing 36 which are to be set is independent of whether the volume flow delivered by the pressure medium pump 27 covers the pressure medium requirement of the pressure chambers 24, 25 to be filled or not. Thus, all that is needed is a single control strategy that can be applied to both operating states of the internal combustion engine 1, thereby further simplifying control of the device 11.

REFERENCE SIGNS

1 internal combustion engine
2 crankshaft
3 piston
4 cylinder
5 flexible drive
6 intake camshaft
7 exhaust camshaft

8 cam
9 intake gas exchange valve
10 exhaust gas exchange valve
11 device
12 phase adjustment unit
13 control valve
14 chain wheel
15 drive input element
16 drive output element
17 side cover
18 hub element
19 vane
20 circumferential wall
21 projection
22 pressure medium space
23 boundary wall
23*a* advance stop
23*b* retardation stop
24 advance chamber
25 retardation chamber
26*a* first pressure medium line
26*b* second pressure medium line
26*p* third pressure medium line
26*v* fourth pressure medium line
26*t* fifth pressure medium line
27 pressure medium pump
28 pressure medium reservoir
29 direction of rotation
30 valve spring
31 volume accumulator
32*a* first pressure medium channel
32*b* second pressure medium channel
33 first check valve
34 second check valve
35 -
36 valve housing
37 radial opening
38 control plunger
39 spring
40 first plunger opening
41 first control area
42 first annular groove
43 second control area
44 third control area
45 second annular groove
46 fourth control area
47 second plunger opening
48 fifth control area
49 sixth control area
50 third check valve
A first working port
B second working port
P inlet port
$V_1$, $V_2$ volume accumulator port
T drain port
S1 first control position
S2 second control position
S3 third control position

The invention claimed is:

1. A device for variably adjusting timing of gas exchange valves of an internal combustion engine, the device comprising:

a hydraulic phase adjustment unit and at least one volume accumulator, wherein the phase adjustment unit is adapted to be brought into driven connection with a crankshaft and driving connection with a camshaft and has at least one advance chamber and at least one retardation chamber, which can be supplied with pressure medium or from which pressure medium can be discharged via pressure medium lines, wherein a phase position of the camshaft relative to the crankshaft can be adjusted in a direction of early timing by supplying pressure medium to the advance chamber while simultaneously allowing pressure medium to flow out of the retardation chamber, wherein a phase position of the camshaft relative to the crankshaft can be adjusted in a direction of late timing by supplying pressure medium to the retardation chamber while simultaneously allowing pressure medium to flow out of the advance chamber, wherein pressure medium can be supplied to the at least one volume accumulator during operation of the internal combustion engine, at least two pressure medium channels are provided wherein a first pressure medium channel of the at least two pressure medium channels opens into the at least one volume accumulator, on the one hand, and communicates with the advance chamber, on the other hand, wherein a second pressure medium channel of the at least two pressure medium channels opens into the at least one volume accumulator, on the one hand, and communicates with the retardation chamber, on the other hand, and wherein each of the pressure medium channels is assigned a check valve, which prevents a pressure medium flow from a respective pressure chamber to the at least one volume accumulator and can permit a pressure medium flow in an opposite direction.

2. The device as claimed in claim 1, wherein the at least one volume accumulator is arranged within the hydraulic phase adjustment unit.

3. The device as claimed in claim 1, wherein the at least one volume accumulator communicates with or is connectable to a pressure medium reservoir of the internal combustion engine via one or more pressure medium lines.

4. The device as claimed in claim 2, wherein the at least one volume accumulator is connectable to a pressure medium reservoir via one or more pressure medium lines, wherein an outlet area of each of the pressure medium channels into the at least one volume accumulator is arranged at a greater distance from an axis of rotation of the phase adjustment unit than an outlet area of each of the pressure medium lines into the at least one volume accumulator.

5. The device as claimed in claim 4, wherein at least one of the pressure medium lines which connect the at least one volume accumulator to the pressure medium reservoir is assigned a check valve, which prevents a pressure medium flow from the pressure medium reservoir to the at least one volume accumulator and can permit a pressure medium flow in the opposite direction.

6. The device as claimed in claim 1, wherein the at least one volume accumulator is fed with pressure medium from the advance and retardation chambers.

7. The device as claimed in claim 1, wherein the at least one volume accumulator is fed with the pressure medium directly from a pressure medium pump.

8. The device as claimed in claim 1, wherein the device has a control valve, by which the pressure medium supply from a pressure medium pump to the advance and retardation chambers and the pressure medium discharge from the advance and retardation chambers is controllable.

9. The device as claimed in claim 8, wherein the control valve has an inlet port (P), a first (A) and a second working port (B) and at least one first volume accumulator port ($V_1$), wherein the first pressure medium line communicates with the first working port (A), on the one hand, and opens into the advance chamber, on the other hand, wherein the second pressure medium line communicates with the second working port (B), on the one hand, and opens into the retardation chamber, on the other hand, wherein a third one of the pressure medium lines is provided, which communicates with the inlet port (P), on the one hand, and communicates with the pressure medium pump, on the other hand, wherein at least a fourth one of the pressure medium lines is provided, which communicates with the at least one volume accumulator port ($V_1$), on the one hand, and opens into the at least one volume accumulator, on the other hand, and wherein a connection between the inlet port (P) and the first or second working port (A, B) and a connection between the at least one volume accumulator port ($V_1$) and the other working port (A, B) can be established by the control valve.

10. The device as claimed in claim 8, wherein the control valve has an inlet port (P), a first (A) and a second working port (B), two volume accumulator ports ($V_1$, $V_2$) and a drain port (T), wherein the first pressure medium line communicates with the first working port (A), on the one hand, and opens into the advance chamber, on the other hand, wherein the second pressure medium line communicates with the second working port (B), on the one hand, and opens into the retardation chamber, on the other hand, wherein a third one of the pressure medium lines is provided, which communicates with the inlet port (P), on the one hand, and with the pressure medium pump, on the other hand, wherein two fourth ones of the pressure medium lines are provided, which open into the at least one volume accumulator, on the one hand, and each communicate with one of the volume accumulator ports ($V_1$, $V_2$), on the other hand, wherein a fifth one of the pressure medium lines is provided, which communicates with the drain port (T), on the one hand, and with the pressure medium reservoir, on the other hand, wherein a connection between the inlet port (P) and the first or second working port (A, B), a connection between one of the volume accumulator ports ($V_1$, $V_2$) and the other working port (A, B) and a connection between the other volume accumulator port ($V_1$, $V_2$) and the drain port (T) can be established by the control valve.

* * * * *